US006226850B1

(12) United States Patent
Parini

(10) Patent No.: US 6,226,850 B1
(45) Date of Patent: May 8, 2001

(54) PICTURE AND ARTICLE DISPLAY AND METHOD

(76) Inventor: Mark J. Parini, 1733 Lexington Ave., El Cerrito, CA (US) 94530

( * ) Notice: Subject to any disclaimer, the term of this patent is extended or adjusted under 35 U.S.C. 154(b) by 0 days.

(21) Appl. No.: 09/249,221

(22) Filed: Feb. 11, 1999

(51) Int. Cl.[7] ..... B21D 39/03

(52) U.S. Cl. ..... 29/428; 40/800; 264/222; 264/223

(58) Field of Search ..... 29/428; 40/700, 40/735, 800, 725; 264/222, 223

(56) References Cited

U.S. PATENT DOCUMENTS

| | | | | |
|---|---|---|---|---|
| 91,100 | * | 6/1869 | Downer | 264/222 |
| 181,008 | * | 8/1876 | Patterson | 40/730 |
| 1,251,791 | * | 1/1918 | Leeland | 40/725 |
| 2,558,650 | * | 6/1951 | Heineman et al. | 206/525 |
| 2,591,565 | | 4/1952 | Linnard . | |
| 2,682,725 | | 7/1954 | Atwood . | |
| 2,909,805 | * | 10/1959 | James | 249/104 |
| 3,786,584 | * | 1/1974 | Holson | 40/124 |
| 3,842,525 | | 10/1974 | Deau . | |
| 4,199,883 | | 4/1980 | Cross . | |
| 4,260,574 | * | 4/1981 | Macomson | 264/129 |
| 4,779,368 | * | 10/1988 | Thede | 40/737 |
| 4,828,116 | * | 5/1989 | Garcia | 206/575 |
| 5,076,438 | * | 12/1991 | Aronson | 206/557 |
| 5,218,774 | | 6/1993 | Mullins . | |
| 5,419,589 | * | 5/1995 | Fattore | 283/62 |
| 5,584,135 | * | 12/1996 | Hosker | 40/800 |
| 5,695,066 | * | 12/1997 | Bartlett | 206/575 |
| 5,897,416 | * | 4/1999 | Barrows | 446/147 |
| 5,950,299 | * | 9/1999 | Perez-Alderete | 29/462 |

OTHER PUBLICATIONS

P. 11 of the Brainstorms Holiday Gift Catalog, 1995 Fall Edition.

* cited by examiner

*Primary Examiner*—S. Thomas Hughes
*Assistant Examiner*—Essama Omgba
(74) *Attorney, Agent, or Firm*—Thomas R. Lampe

(57) ABSTRACT

A kit and method for creating an article display includes a frame having two openings. The completed display includes a clay tablet having an impression formed therein located within one of the frame openings and a picture located in the other frame opening. The invention is suitable for making impressions of baby's hands or feet and displaying a picture of the baby along with the tablet carrying the impressions.

7 Claims, 5 Drawing Sheets

PICTURE AND ARTICLE DISPLAY AND METHOD

TECHNICAL FIELD

This invention relates to the display of articles. In particular, the invention is for the purpose of forming and displaying a tablet having the impressions of an individual's hands or feet along with a photograph of that individual. The invention encompasses an apparatus and a method.

BACKGROUND OF THE INVENTION

Arrangements have been devised in the past for making and displaying impressions of portions of an individual's body, particularly hand impressions. U.S. Pat. No. 2,591,565, for example, discloses a method of forming hand or feet impressions in clay while the clay is disposed in a metal pan. The metal pan and clay therein are then mounted and clamped to the rear of a frame of metal or other material having a rectangular opening. The clay is dried in the frame. The patent teaches that the raised edges of the clay panel are clamped by clamping elements so that they firmly engage the contiguous edge of the rectangular opening in the frame while the clay drys.

U.S. Pat. No. 2,682,725, issued Jul. 6, 1954 illustrates the use of a molding kit to form impressions of children's hands or footprints, the impressions being made in plaster of Paris.

A molding kit incorporating molding material and plaster to form plaques preserving impressions of hands or feet is shown on page 11 of the Brainstorms Holiday Gift Catalog, 1995 Fall edition.

U.S. Pat. No. 3,842,525, issued Oct. 22, 1974, illustrates a picture frame and plaque including double frame members which are permanently sealed in a spaced parallel relationship. The frame is constructed to permit ready removal and replacement of a graphical display employed in combination with plaques, display boards or the like.

Other representative prior art display mounts and frame displays are shown in U.S. Pat. No. 4,199,883, issued Apr. 29, 1980, and U.S. Pat. No. 5,218,774, issued Jun. 15, 1993.

DISCLOSURE OF INVENTION

The present invention relates to an article display kit of unique character which is employed to readily construct and form a display including a tablet having one or more impressions therein and a photograph or other picture. The invention is particularly applicable to taking hand or foot impressions of a child and displaying them along with a depiction of the child.

This may be accomplished readily and the kit is relatively simple and inexpensive. Furthermore, no undesirable mess is created in the process as compared for example with existing hand or feet impression kits employing plaster of Paris and similar substances.

The article display kit of the present invention includes a frame having a frame front and a frame back and defining first and second openings therein at the frame front.

A pliable impression member for taking an impression of a person's hand or foot is also included in the kit.

The combination also includes a container containing the impression member and sealing the impression member from the ambient atmosphere to maintain the impression member in pliable condition, the impression member and the container being positioned in the first opening.

Means is provided for releasably holding the impression member and the container in the first opening and allowing an individual to remove the impression member and the container from the opening whereby the container may be removed from the impression member and an impression made in the impression member while the impression member is in pliable condition.

Picture retention means is provided for retaining a picture in the second opening to display the picture. The picture may, for example, be of a child who made the impression in the impression member.

Impression member retention means is provided for retaining the impression member in the first opening for display thereof after an impression has been made in the impression member and after the impression member has been hardened to fix the impression in the impression member.

In the preferred embodiment of the invention disclosed herein the impression member comprises a clay tablet.

Other features, advantages, and objects of the present invention will become apparent with reference to the following description and accompanying drawings.

BEST MODE FOR CARRYING OUT THE INVENTION

Figure 1:
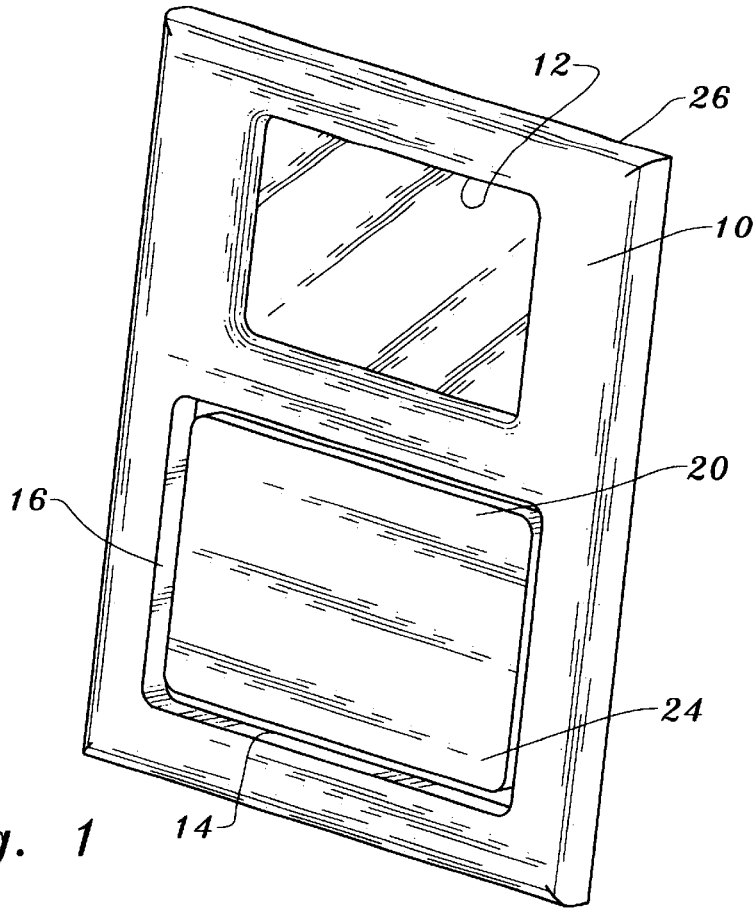
FIG. 1 is a frontal, perspective view illustrating an article display kit constructed in accordance with the teachings of the present invention.

FIG. 1 illustrates an article display kit constructed in accordance with the teachings of the present invention. With reference to FIG. 1 as well as the other figures of the drawings, the kit includes a frame 10 constructed of any suitable material, for example plastic or wood, having two openings, openings 12 and 14, formed therein. Opening 12 passes completely through the frame while opening 14 is in the form of a recess defined by rectangular wall 16 and an inner wall 18 extending between the rectangular wall.

Located within opening 14 and supported by inner wall 18 is a clay tablet 20 encased in a container 22 in the form of a plastic bag. The plastic bag is moisture proof and protects the clay tablet from the ambient atmosphere.

The clay of the clay tablet is relatively moist and is pliable. That is, the clay tablet is suitable for making impressions therein as will be discussed below.

A template 24 constructed of any suitable material such as paperboard occupies the interior of opening 14 with the clay tablet 20 and container 22.

Overwrapping the frame is a removable overwrap which may suitably be in the form of a shrink fit plastic bag 26 which serves to maintain the other components of the kit together. Clay tablet 20 is prevented from falling out of opening 14 by its engagement with the overwrap 26.

Figure 2:
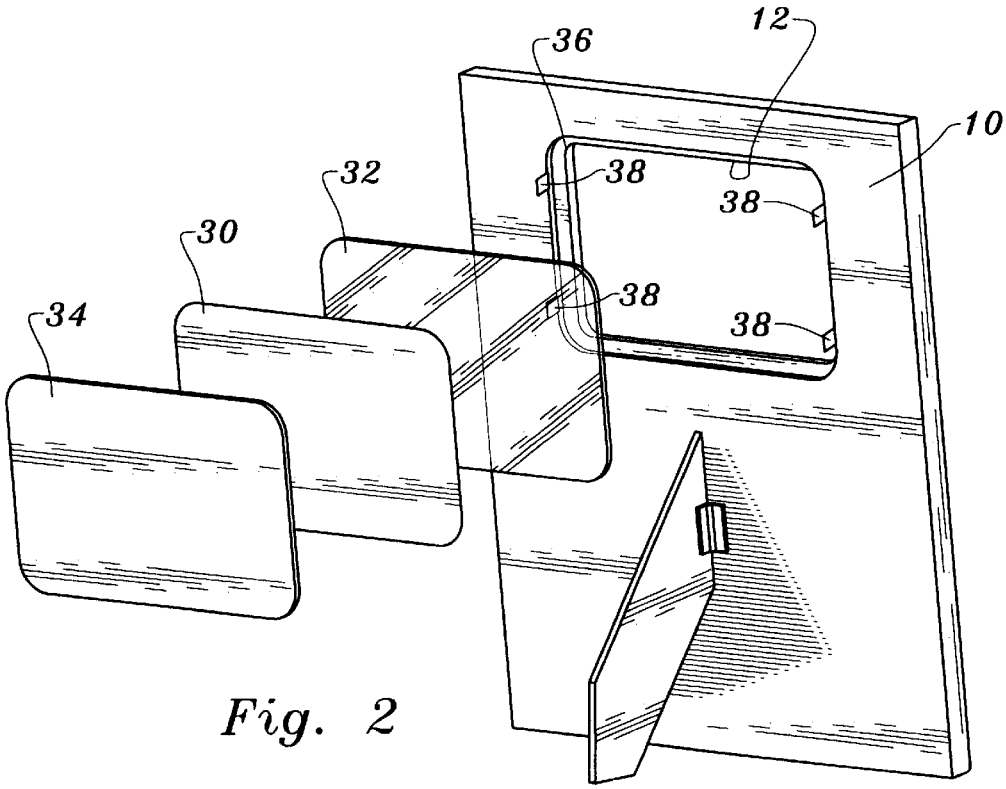
FIG. 2 is a rear perspective view of the frame of the invention illustrating a photograph being positioned in an opening for display purposes.

FIG. 2 illustrates the back of the frame with the overwrap 26 having been removed therefrom to illustrate additional details of opening 12 and the kit structure which is employed to maintain a picture such as a photograph 30 in opening 12. Picture 30 is not part of the article display kit when sold but is provided by the user thereof. However, included in the article display kit is a glass cover 32 and a backing panel 34 formed of paperboard or the like. The photograph 30 is sandwiched between the glass cover 32 and backing panel 34 and inserted into opening 12, at which point the glass cover engages a ledge 36 at the opening. Bendable tabs 38 of metal or the like are bent over backing panel 34 to retain the photograph or other picture in place relative to the frame.

Figure 3:
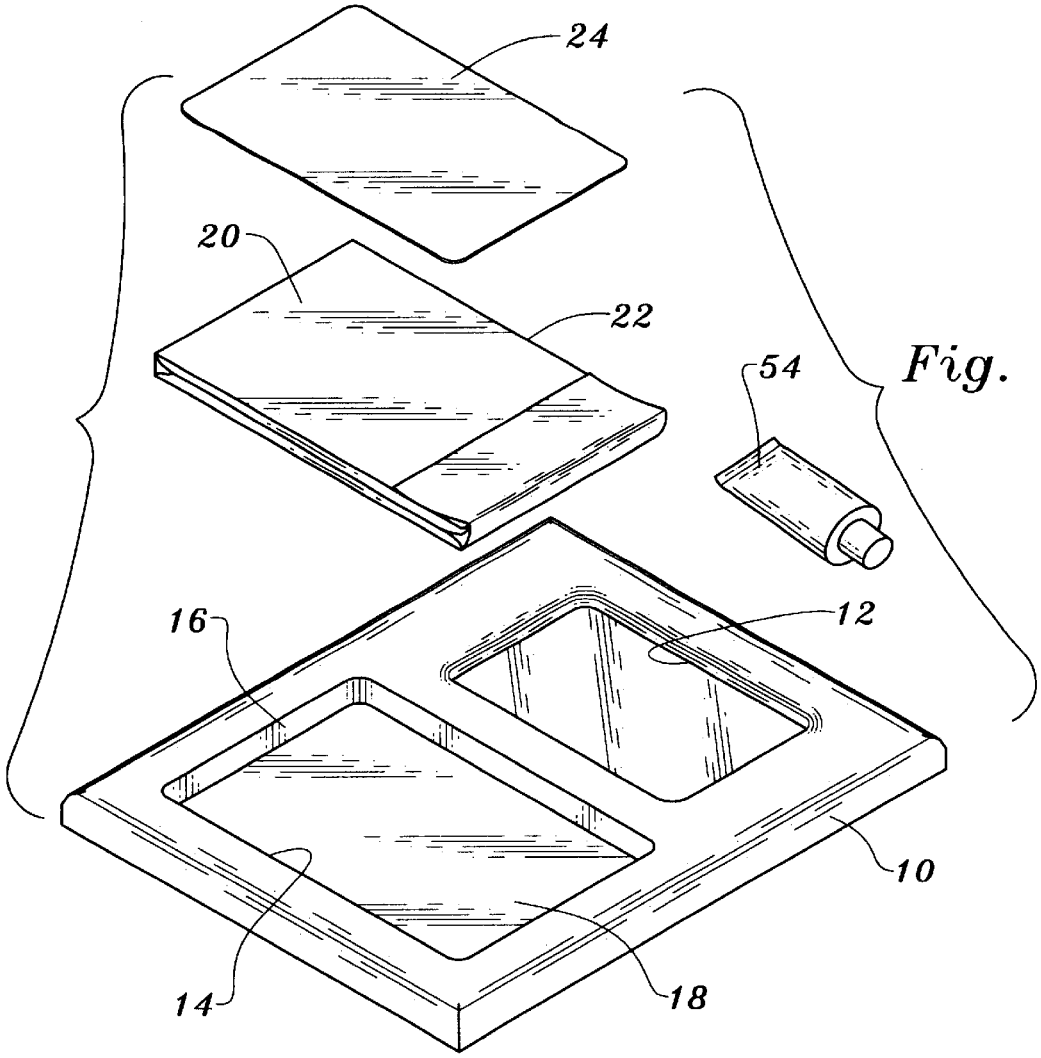
FIG. 3 is an exploded perspective view illustrating several structural elements of the article display kit of the invention including a frame having two openings therein and an impression member in the form of a clay tablet wrapped by a moisture resistant container prior to forming hand impressions in the clay tablet.

FIG. 3 shows the clay tablet 20 in its container 22 and the template 24 having been removed from the frame after the overwrap 26 has been removed therefrom by the user. The plastic bag or container 22 is then removed from the clay tablet 20 and the clay tablet is placed on a support surface as shown in FIG. 4.

Figure 4:
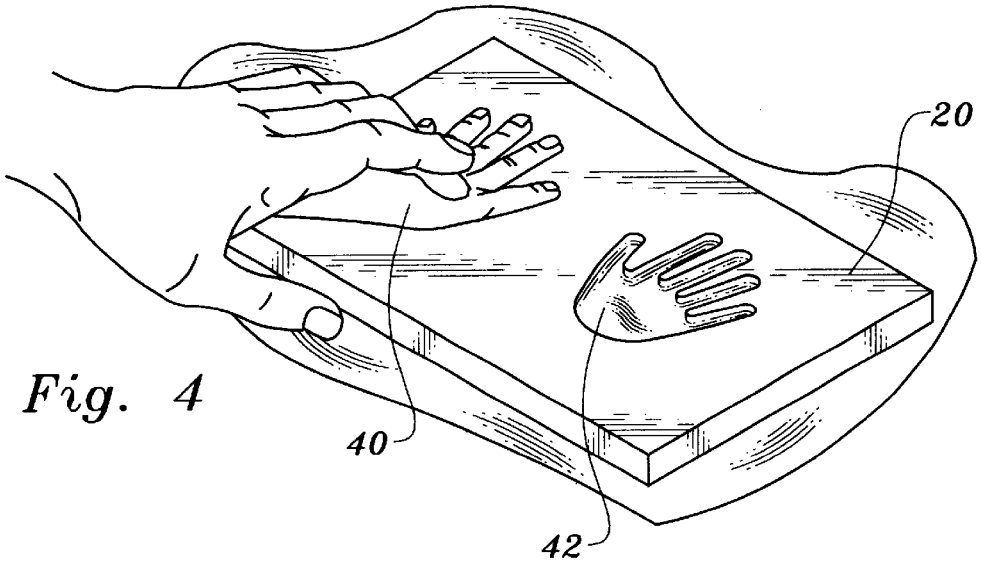
FIG. 4 is a perspective view illustrating an impression being made of the hand of an infant in the clay tablet.

FIG. 4 illustrates a baby's hand 40 being impressed into the pliant, relatively moist clay tablet 20 to form an impression therein. In FIG. 4, one such impression 42 has already been made in such fashion. If a user finds that the clay is too firm to get a good print or impression, the clay tablet should be moistened somewhat. One way to accomplish this is to moisten a paper towel, lay the paper towel on the clay tablet and seal the clay and paper towel in a bag for several hours.

Figure 5:
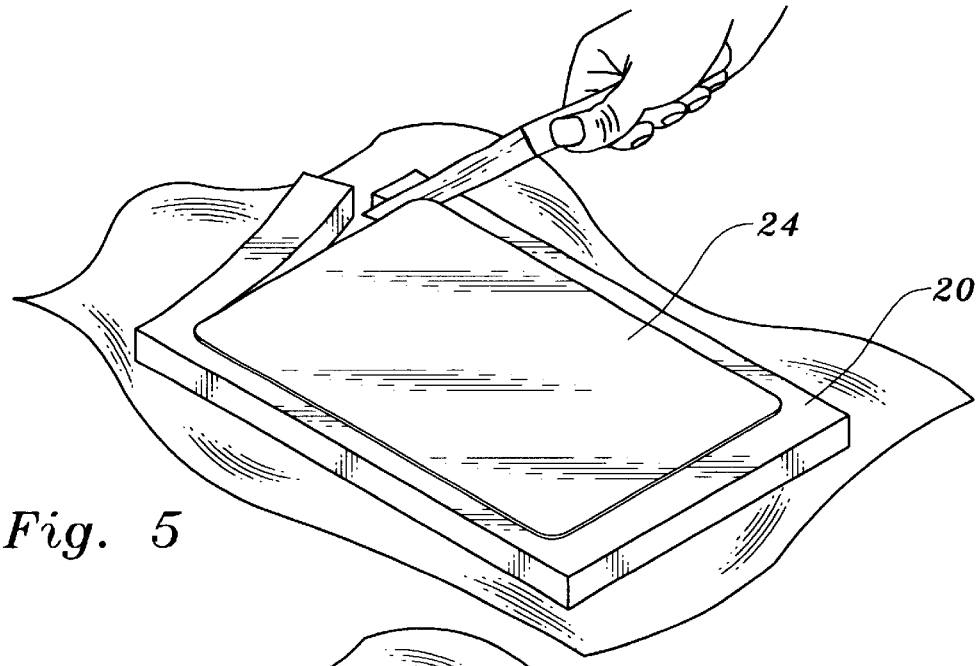
FIG. 5 is a perspective view illustrating a trimming step which may be carried out when practicing the invention method.

Template 24, which served as a protective cover for the clay tablet when the clay tablet was incorporated in the assembled kit package, can be employed as shown in FIG. 5 to ensure that the clay tablet will fit back into opening 14 of the picture frame after the baby's hands are impressed into the clay. It will be appreciated that compression of the clay tablet during the impression making process can result in some spreading out of the clay at the outer periphery thereof. The template is placed on the clay tablet and any clay projecting outside the template can be trimmed away with a knife as shown in FIG. 5.

Figure 6:
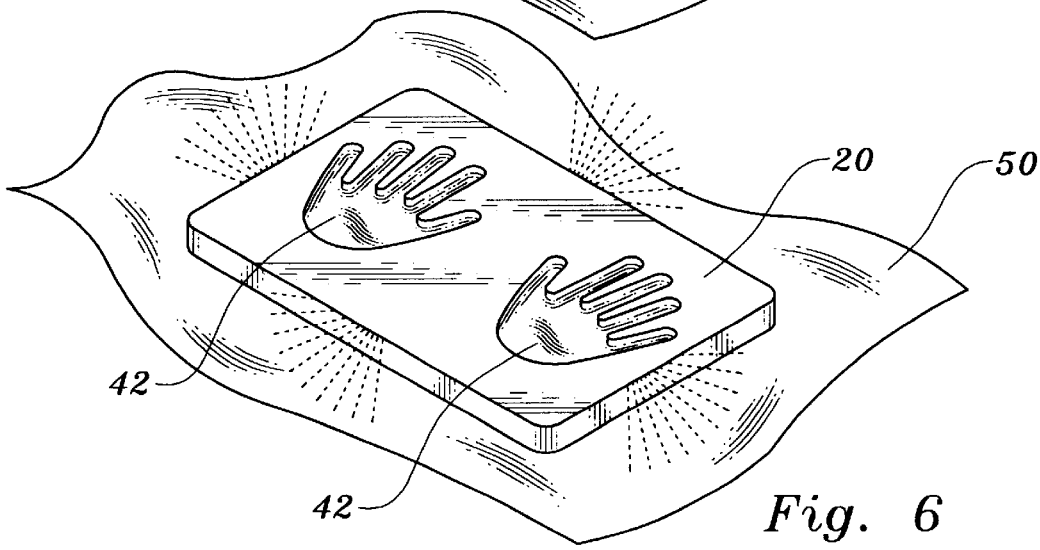
FIGS. 6 and 7 are perspective views illustrating drying of the clay tablet after impressions have been formed therein right side up and upside down, respectively.
Figure 7:
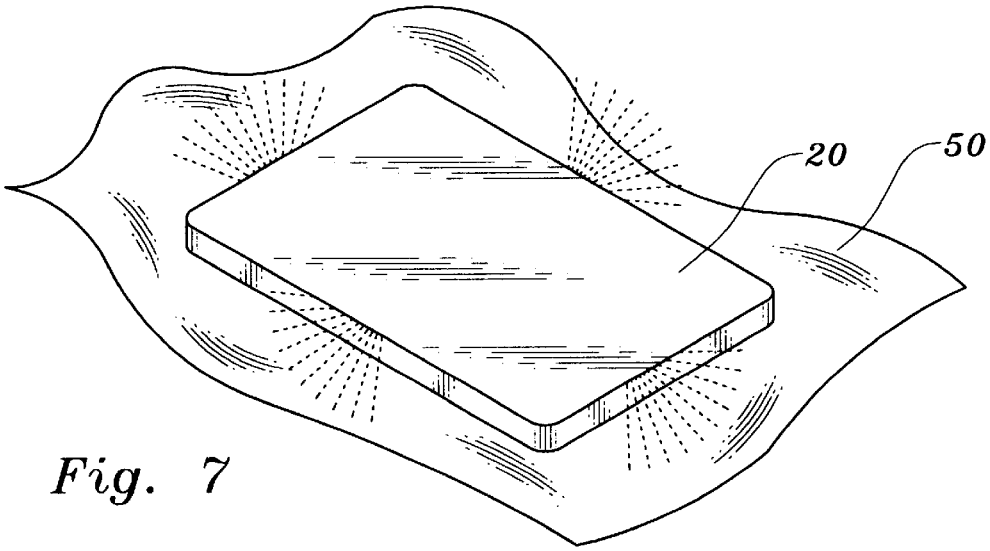

After the clay tablet has been trimmed and the desired impressions made therein, it is dried. FIG. 6 shows the moist or pliant clay tablet on a towel 50 with impressions 42 facing upwardly. The clay tablet should be flat. If it is not, a person can pat it gently to flatten it. After the exposed upper surface of the clay tablet is leather hard, the tablet should be turned over to allow the other side to dry as well. This is shown in FIG. 7.

The clay usually takes approximately 3 to 4 days to dry depending upon the weather. The clay should look dry and not feel clammy to the touch.

Figure 8:
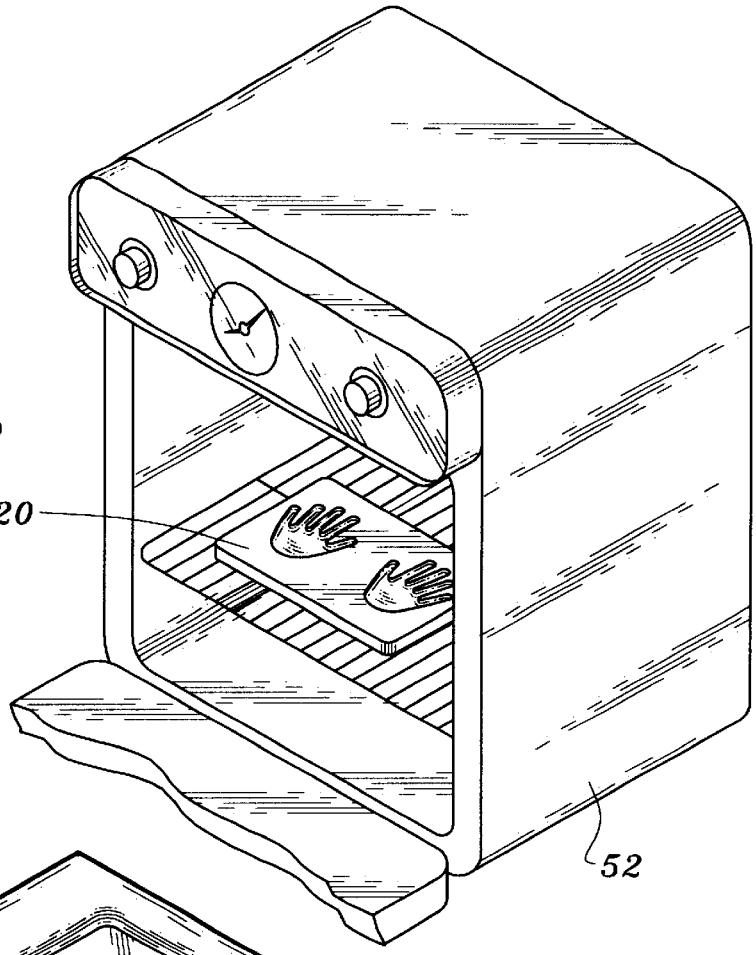
FIG. 8 illustrates the clay tablet with impressions formed thereon in the interior of a drying oven.

Once the clay is dry the tablet should be placed in a cold oven. The oven thermostat should be set to approximately 350 degrees or slightly lower. It takes approximately one hour for the clay to become completely hardened and baked. The person performing this operation should let the baked clay cool completely at this point. FIG. 8 illustrates clay tablet 20 in a conventional oven 52. A microwave oven preferably should not be employed when practicing this method.

Figure 9:
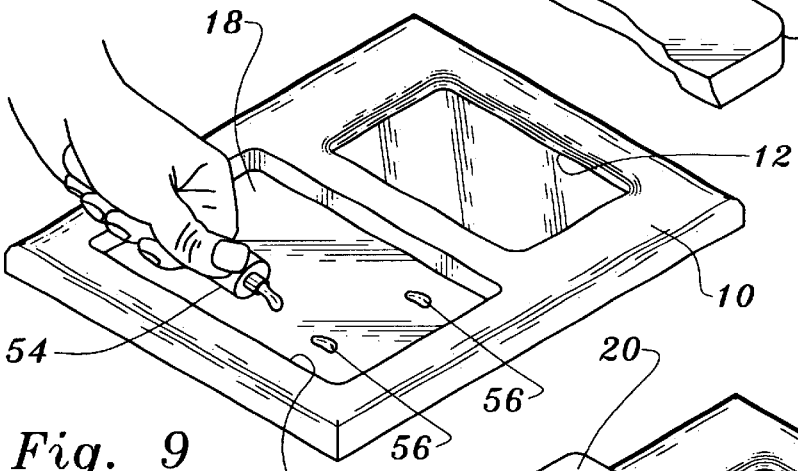
FIG. 9 is a perspective view illustrating the application of an adhesive to the frame in one of the openings of the frame.
Figure 10:
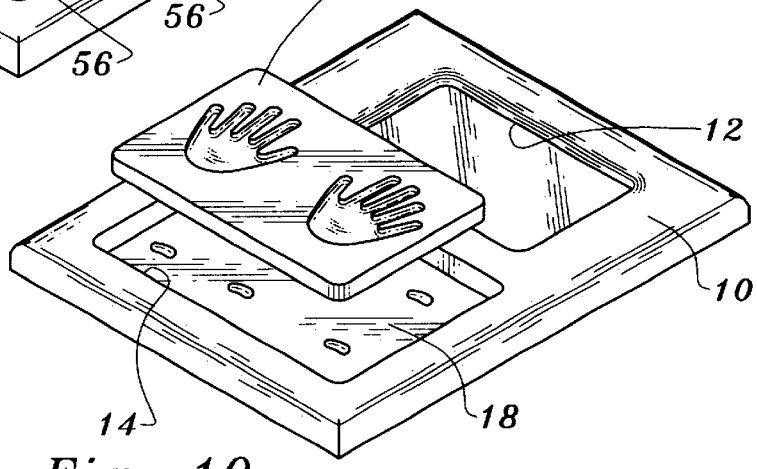
FIG. 10 illustrates the dried clay tablet being placed into the opening of the frame accommodating the adhesive.
Figure 11:
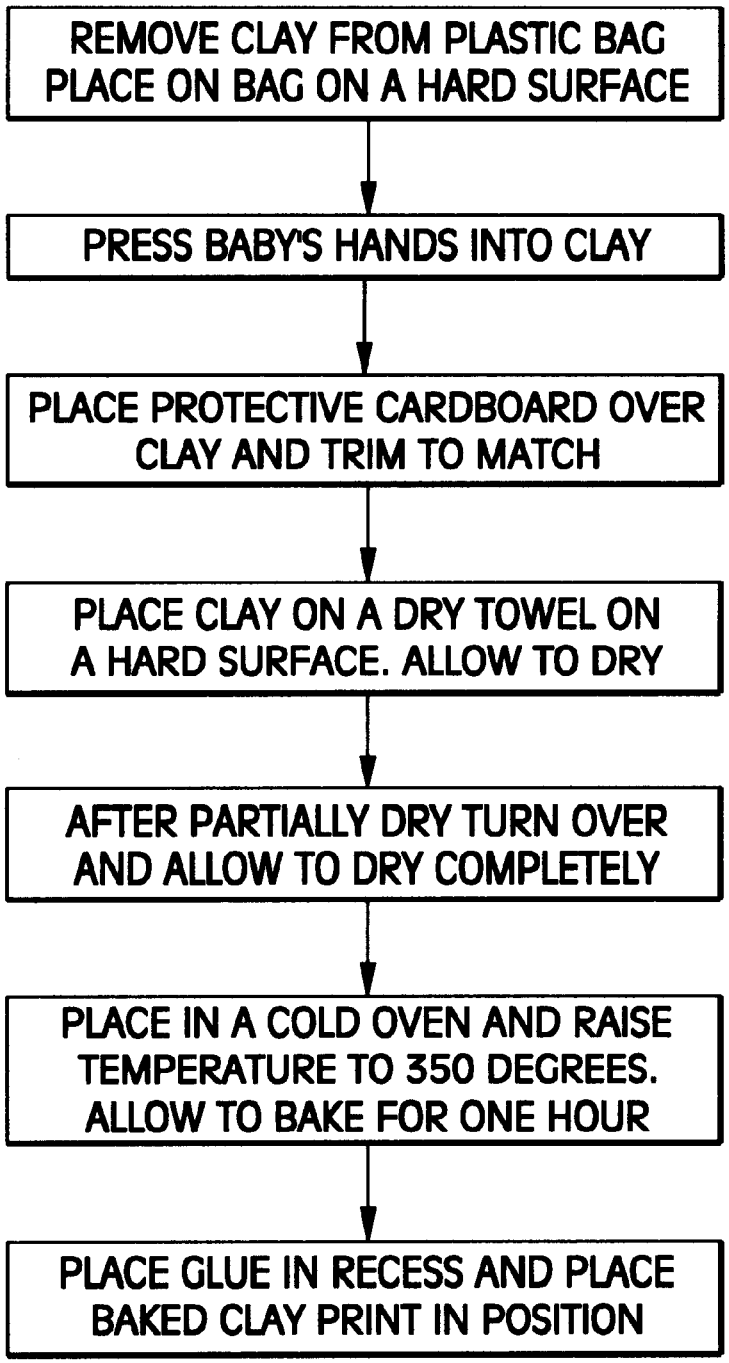
FIG. 11 is a block diagram illustrating steps carried out during practice of the method of the present invention.

The article display kit disclosed herein also includes a tube 54 of glue or adhesive. The tube is squeezed as shown in FIG. 9 to apply portions 56 of adhesive at spaced locations on inner wall 18 of opening 14. After this has been accomplished the clay tablet 20 is placed into the recess or opening 14 as shown in FIG. 10 and pressed into engagement with the adhesive. After the adhesive drys, the frame, clay tablet and photograph are ready for display and present a pleasing appearance.

What is claimed is:

1. A method of forming a decorative display, said method comprising the steps of:

forming a package including a frame having first and second openings therein and an impression member in moist, pliable condition disposed in said first opening;

keeping said impression member in moist, pliable condition while said impression member is packaged with said frame and in said first opening by maintaining said moist, pliable impression member in a moisture proof, flexible container wrapping said moist, pliable impression member, said moisture proof, flexible container being maintained in said first opening to seal said moist, pliable impression member from the ambient atmosphere;

incorporating a template generally corresponding in size to said first opening in said package along with said moist, pliable impression member and said moisture proof, flexible container;

removing said template. said moisture proof, flexible container and said moist, pliable impression member from said package;

exposing said removed moist, pliable impression member to the ambient atmosphere by removing the moisture proof, flexible container therefrom;

while said impression member is still moist and pliable and exposed to the atmosphere, forming an impression in said impression member by an individual exerting a compressive force on the moist, pliable impression member;

determining whether the outer peripheral size of the moist, pliable impression member exceeds the outer peripheral size of said template after the step of forming the impression and trimming any excess impression member material from the moist, pliable impression member so that the outer peripheral size of the moist, pliable impression member substantially conforms to the outer peripheral size of the template;

drying the impression member after the compressive force has been applied thereto to harden the impression member and retain said impression in said impression member;

after hardening of the impression member, repositioning the impression member in said first opening of said frame to display the impression formed in said impression member; and retaining said impression member in said first opening in hardened condition after said impression member has been repositioned in said first opening.

2. The method according to claim 1 wherein said step of hardening said impression member comprises maintaining said moist, pliable impression member exposed to the ambient atmosphere for a period of time after said step of forming said impression to dry said impression member.

3. The method according to claim 2 wherein said step of hardening said impression member further comprises subjecting said impression member to heat for a period of time after exposing said impression member to the ambient atmosphere.

4. The method according to claim 1 including the additional steps of placing a picture of the individual who made the impression in said second opening and retaining said picture for display of said picture in said frame with said impression member.

5. The method according to claim 1 wherein the step of forming said impression comprises placing either the hand or foot of said individual in engagement with said moist, pliable impression member.

6. The method according to claim 1 including the additional step of increasing the moisture content of said impression member after the step of removing the impression member from the package to increase the pliability of said impression member.

7. The method according to claim 1 wherein said trimming step comprises placing said moist, pliable impression member in engagement with said template and cutting the impression member to conform to the outer peripheral shape of said template.

* * * * *